US010619964B2

(12) United States Patent
Cole

(10) Patent No.: US 10,619,964 B2
(45) Date of Patent: Apr. 14, 2020

(54) MODIFIED PISTOL UPPER

(71) Applicant: Palmetto State Armory, LLC, Columbia, SC (US)

(72) Inventor: Jonathan Brent Cole, Gaston, SC (US)

(73) Assignee: Palmetto State Armory, LLC, Columbia, SC (US)

( * ) Notice: Subject to any disclaimer, the term of this patent is extended or adjusted under 35 U.S.C. 154(b) by 0 days.

(21) Appl. No.: 15/867,806

(22) Filed: Jan. 11, 2018

(65) Prior Publication Data

US 2018/0195826 A1 Jul. 12, 2018

Related U.S. Application Data

(60) Provisional application No. 62/444,825, filed on Jan. 11, 2017.

(51) Int. Cl.
*F41A 21/32* (2006.01)
*F41C 23/16* (2006.01)

(52) U.S. Cl.
CPC ..... *F41A 21/32* (2013.01); *F41C 23/16* (2013.01)

(58) Field of Classification Search
CPC ..... F41A 21/32; F41A 21/325; F41A 21/34; F41A 21/36; F41A 21/38; F41A 21/40; F41A 21/42; F41A 21/482
See application file for complete search history.

(56) References Cited

U.S. PATENT DOCUMENTS 1,487,312 A * 3/1924 Bull ..... F41A 21/34 123/198 R
2,101,848 A * 12/1937 Green ..... F41A 21/34 181/223
2,191,484 A * 2/1940 Hughes ..... F41A 21/38 89/14.3
2,869,272 A * 1/1959 Coyle ..... F41A 21/42 42/79
3,075,314 A * 1/1963 Bakker ..... F41A 13/12 42/71.01
3,090,150 A * 5/1963 Stoner ..... F41A 13/12 42/71.01
3,181,262 A * 5/1965 Bridge, Sr. ..... F41A 21/40 42/112
3,528,336 A * 9/1970 Donner ..... F41A 21/32 181/223
4,479,418 A * 10/1984 Beretta ..... F41A 21/30 89/14.4
4,713,904 A * 12/1987 Anderson ..... F41A 21/40 42/79
5,119,716 A * 6/1992 Bartolles ..... F41A 21/30 89/14.3
5,271,312 A * 12/1993 Lishness ..... F41A 21/484 42/76.01
5,325,617 A * 7/1994 Vojta ..... F41A 11/02 42/75.03
6,050,170 A * 4/2000 Guiette ..... F41A 21/10 89/29

(Continued)

*Primary Examiner* — Derrick R Morgan
(74) *Attorney, Agent, or Firm* — Burr & Forman LLP; Doulas L. Lineberry

(57) ABSTRACT

A modified muzzle device designed to utilize the threads of a rifle barrel to hold a standard handguard retainer at the proper length to use a carbine length handguard on the upper assembly of a weapon.

13 Claims, 6 Drawing Sheets

(56) References Cited

U.S. PATENT DOCUMENTS 7,353,740 B1 * 4/2008 Hoffman ..... F41A 21/26 42/107
7,464,496 B1 * 12/2008 Davies ..... F41A 21/24 42/75.02
7,770,317 B1 * 8/2010 Tankersley ..... F41C 23/16 42/71.01
7,891,282 B1 * 2/2011 DeGroat ..... F41A 21/325 181/223
8,087,337 B1 * 1/2012 Cary ..... F41A 21/36 89/14.3
8,291,805 B1 * 10/2012 Quilligan ..... F41A 21/325 285/305
9,658,010 B1 * 5/2017 Oglesby ..... F41A 13/12
9,964,376 B2 * 5/2018 Odle ..... F41A 21/325
2007/0017139 A1 * 1/2007 Larue ..... F41A 21/482 42/75.1
2010/0282066 A1 * 11/2010 Tankersley ..... F41A 5/26 89/193
2011/0023699 A1 * 2/2011 Barrett ..... F41A 5/28 89/193
2011/0056364 A1 * 3/2011 Kennedy ..... F41A 21/26 89/14.05
2012/0048100 A1 * 3/2012 Davies ..... F41A 21/34 89/14.2
2012/0180359 A1 * 7/2012 Fitzpatrick ..... F41C 23/16 42/71.01
2012/0228052 A1 * 9/2012 Findlay ..... F41A 21/30 181/223
2013/0036648 A1 * 2/2013 Shipman ..... F41C 23/16 42/108
2013/0133976 A1 * 5/2013 Johansen ..... F41A 21/30 181/223
2014/0150318 A1 * 6/2014 Engesser ..... F41A 21/481 42/75.02
2014/0157640 A1 * 6/2014 Whelan ..... F41C 23/16 42/75.02
2015/0135575 A1 * 5/2015 Wood, Jr. ..... F41A 21/325 42/90
2015/0135576 A1 * 5/2015 Wells ..... F41C 23/16 42/90
2015/0184960 A1 * 7/2015 Monveldt ..... F41A 5/26 89/193
2015/0323275 A1 * 11/2015 Lessard ..... F41A 21/34 89/14.4
2016/0010935 A1 * 1/2016 Clarke ..... F41A 21/34 89/14.4
2016/0010936 A1 * 1/2016 Moon ..... F41A 21/36 89/14.3
2016/0033225 A1 * 2/2016 Selvetti ..... F41A 21/482 89/14.05
2017/0038178 A1 * 2/2017 Pinilla ..... F41G 11/003
2017/0074613 A1 * 3/2017 Shults ..... F41A 21/30
2017/0097205 A1 * 4/2017 Palu ..... F41A 21/30
2017/0115084 A1 * 4/2017 Hailey ..... F41A 21/28
2017/0160037 A1 * 6/2017 Gray ..... F41A 21/482
2017/0299291 A1 * 10/2017 Spector ..... F41G 11/003
2017/0307322 A1 * 10/2017 Davis ..... F41A 21/30
2018/0202744 A1 * 7/2018 De Sousa ..... F41A 21/30
2018/0245872 A1 * 8/2018 Jen ..... F41A 21/325
2018/0274873 A1 * 9/2018 Thomas ..... F41A 21/30
2019/0072354 A1 * 3/2019 Lee ..... F41A 21/44
2019/0195589 A1 * 6/2019 Lee ..... F41A 21/30

* cited by examiner

MODIFIED PISTOL UPPER

BACKGROUND OF THE INVENTION

1) Field of the Invention

The present invention relates to a modified pistol upper employing a novel muzzle device that allows for using standard length rifle handguards with the pistol upper.

2) Description of Related Art

Current AR-15 platforms use a shoulder machined into the barrel to position the front sight base and hand guard retainer on the barrel to the correct length. Pins are typically drilled into the barrel to hold it into place. See FIG. 1. Due to this configuration, a barrel shorter than 8.75 inches is not long enough to hold a standard front sight base and carbine length handguard in place, most pistol upper assemblies use a free-floating hand guard. This allows the barrel to free float and will not accommodate the use of a standard polymer handguard. FIG. 2 shows an example of a free float pistol upper.

Accordingly, it is an object of the present invention to improve over past pistol upper designs to allow a user to employ a standard carbine length handguard retainer on a pistol upper assembly.

SUMMARY OF THE INVENTION

In a first embodiment, the current disclosure provides a muzzle device for a firearm. The muzzle device includes a muzzle body, which may be substantially cylindrical in shape, with a proximal and distal end, a muzzle shelf defined adjacent the proximal end of the muzzle body formed substantially perpendicular to the muzzle body, a hollow muzzle stem extending from the muzzle shelf, and an anti-rotation pin cavity defined within the muzzle shelf. In a further embodiment, muzzle teeth may be formed along the periphery of the proximal end of the muzzle body extending away from the distal end of the muzzle body. In yet another embodiment, the muzzle stem may be threaded on an interior of the muzzle stem. Still further, the pin cavity may be substantially circular. In another embodiment, the muzzle stem may include a stem notch defined within an outer surface of the muzzle stem. Still even further, the muzzle body may include muzzle end divots defined in the distal periphery of the muzzle body. In a further embodiment, the hollow muzzle stem may be configured to allow a bullet to pass through an entirety of the muzzle stem.

In an alternative embodiment, a method of preventing rotation in a firearm is provided. The method may include securing a muzzle device to the firearm, wherein the muzzle device may include a muzzle body, which may be substantially cylindrical in shape, with a proximal and distal end, a muzzle shelf defined adjacent the proximal end of the muzzle body formed substantially perpendicular to the muzzle body, a hollow muzzle stem extending from the muzzle shelf, and an anti-rotation pin cavity may be defined within the muzzle shelf. Further, an anti-rotation pin may be inserted through the anti-rotation pin cavity in the muzzle shelf and into a pin locking orifice affixed to the firearm. In a further embodiment, the pin locking orifice may be formed by defining a cavity in a handguard retainer. Still further, the pin locking orifice may be formed by affixing a member defining a cavity to the firearm other than a handguard retainer. In a yet further embodiment, muzzle teeth may be formed along the periphery of the proximal end of the muzzle body extending away from the distal end of the muzzle body. Still yet further, the muzzle stem may be threaded on an interior of the muzzle stem. Still further yet, the pin cavity may be substantially circular. Yet further, the muzzle stem may include a stem notch defined within an outer surface of the muzzle stem. Yet even further, the muzzle body may include muzzle end divots defined in the distal periphery of the muzzle body. Further yet, the hollow muzzle stem may be configured to allow a bullet to pass through an entirety of the muzzle stem.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
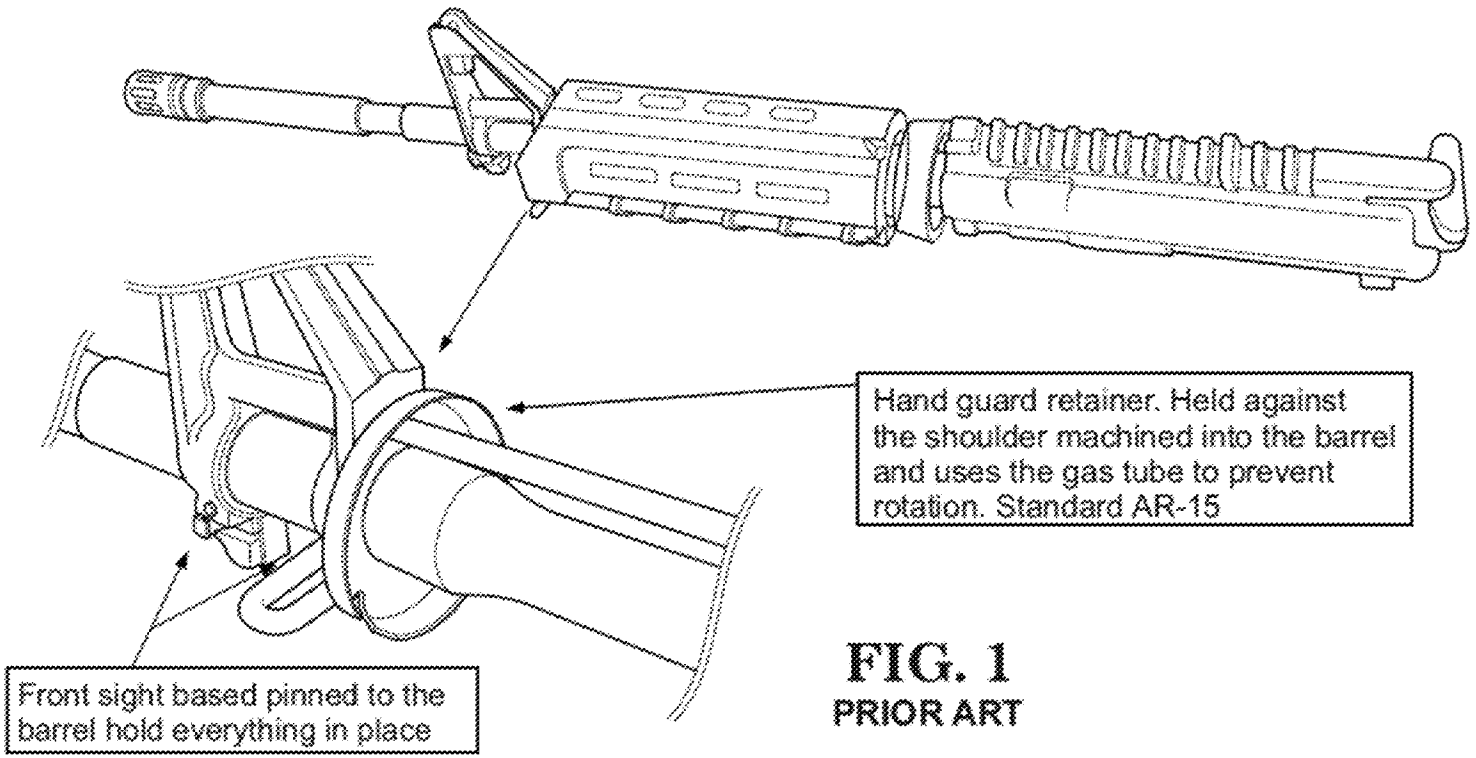
FIG. 1 PRIOR ART
FIG. 1 shows a prior art AR-15 barrel assembly.
Figure 2:
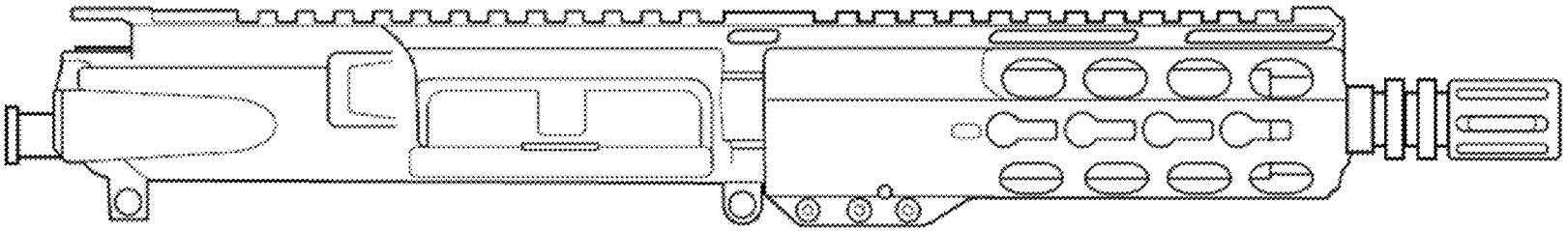
FIG. 2 PRIOR ART
FIG. 2 shows a prior art free floating pistol upper.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 3:
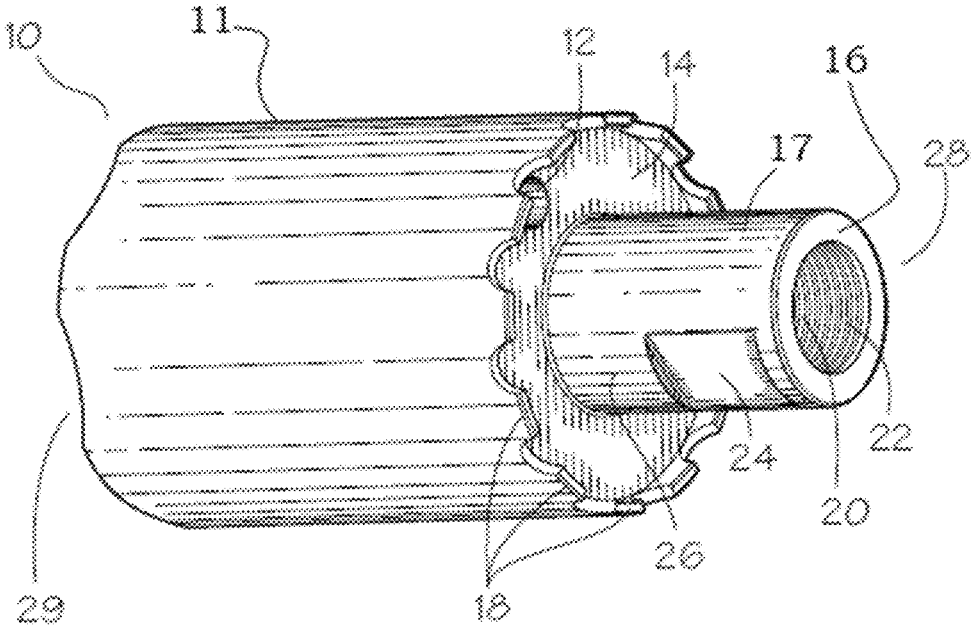
FIG. 3 shows a side view of a muzzle device of the current disclosure.

FIG. 3 shows one embodiment of a muzzle device 10 of the current disclosure. Muzzle device 10 may be made from plastics, metals, polymers, capable of withstanding heat from extreme use. In a further embodiment, the muzzle device may be made from a metal such as aluminum or steel. Muzzle device 10 may include a muzzle body 11, which may be substantially cylindrical in shape. In other embodiments, muzzle body 11 may have an angular, polygonal or irregular shape. Muzzle device 10 may define an anti-rotation pin cavity 12 defined into muzzle shelf 14 of muzzle device 10. While pin cavity 12 is shown as round, the current disclosure should not be read as limited to this shape but includes shapes such as polygon, star, specifically shaped orifices, such as irregular sided surfaces, oblongs, etc. The pin cavity may be various sizes as long as the pin is not larger in diameter than the hole in the handguard retainer stamping. In one embodiment, the diameter is 3/16". Muzzle device 10 may also include muzzle stem 16. Muzzle stem 16 passes through muzzle shelf 14 and may pass through interior 31, see FIG. 4, of muzzle device 10 or may end proximate muzzle shelf 14. Muzzle stem 16 may have various lengths. In one preferred embodiment, muzzle stem 16 is 1.050". This length is critical to ensure the distance between the barrel nut-delta ring assembly and the hand guard retainer is nominally 6.500" when utilizing a 7" barrel and a standard crush washer. This length ensures the polymer handguard will fit the weapon properly. Muzzle device 10 may also include muzzle teeth 18, which serve to dissipate heat. Heat dissipation is accomplished by limiting contact to the steel handguard retainer and allowing air to flow freely through the openings. In this way, heat transfer to the polymer handguard is greatly reduced during periods of extensive use. The size and/or shape of teeth 18 may be changed for aesthetic reasons. Muzzle stem 16 may have an exterior 17 and an interior 20. Interior 20 may contain threads 22 for affixing muzzle device 10 to the end of a rifle. Muzzle device 10 may also have a stem notch 24 formed in the outer surface 26 of muzzle stem 16. Stem notch 24 provides a grasping point for installing and tightening muzzle device 10 to a rifle muzzle. Muzzle device 10 may have a proximal end 28 and a distal end 29 as well.

In a preferred embodiment, muzzle device 10 is designed to engage with the muzzle threads of an industry standard rifle barrel, such as a seven inch barrel, hold a standard handguard retainer in place, as well as prevent muzzle device rotation while utilizing a standard carbine length polymer handguard. A crush washer, not shown, may be used in conjunction with muzzle device 10 to keep muzzle device 10 in place during use.

Figure 4:
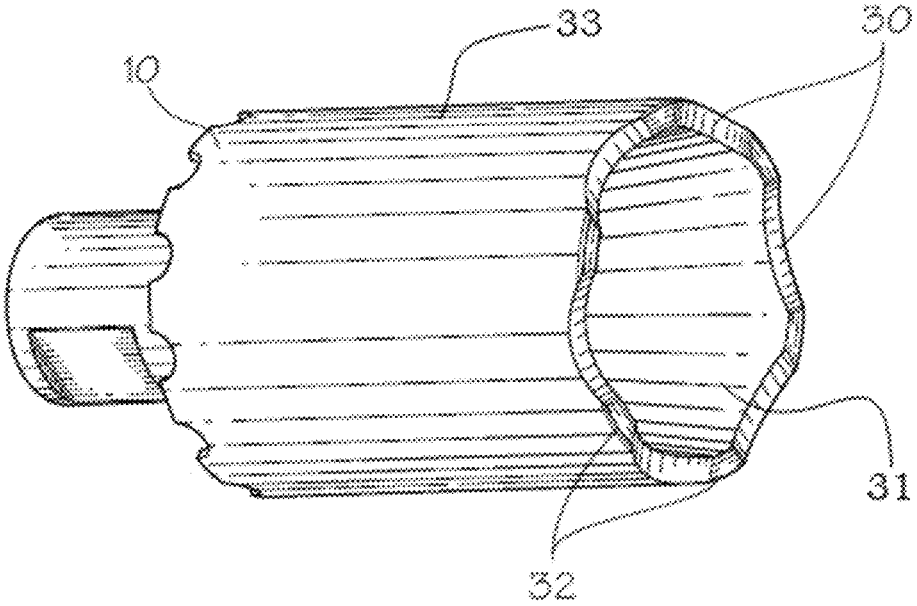
FIG. 4 shows a side view of a muzzle device of the current disclosure.

FIG. 4 shows a side view of muzzle device 10. As FIG. 4 shows, muzzle device 10 may also include an interior 31, an exterior 33, muzzle end divots 30 and crests 32. Formations 30 may have various shapes including smooth waves, angles, polygons, etc.

Figure 5:
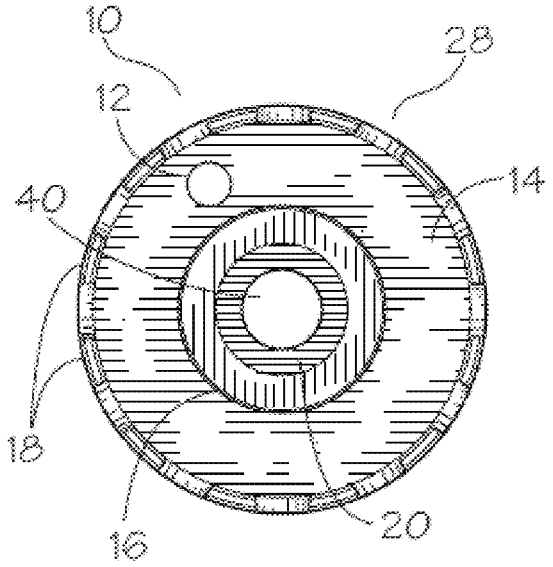
FIG. 5 shows an elevation view of the proximal end of a muzzle device of the current disclosure.
Figure 6:
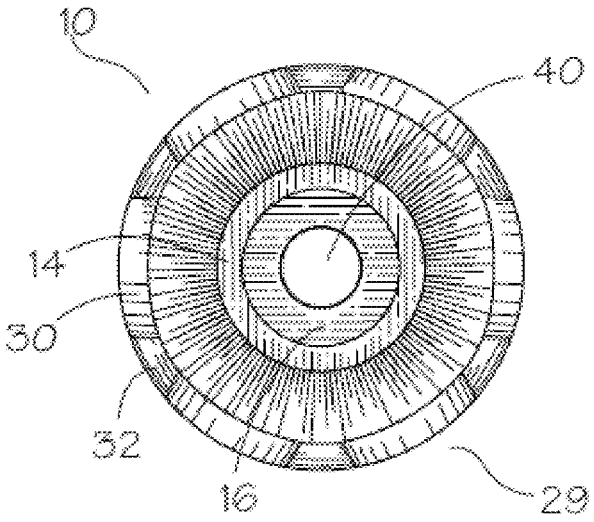
FIG. 6 shows an elevation view of the distal end of a muzzle device of the current disclosure.

FIG. 5 shows an elevation view of proximal end 28 of muzzle device 10. As FIG. 5 shows, muzzle device 10 may define an opening 40 through which a bullet may pass. FIG. 6 shows an elevation view of distal end 29 of muzzle device 10.

Figure 7:
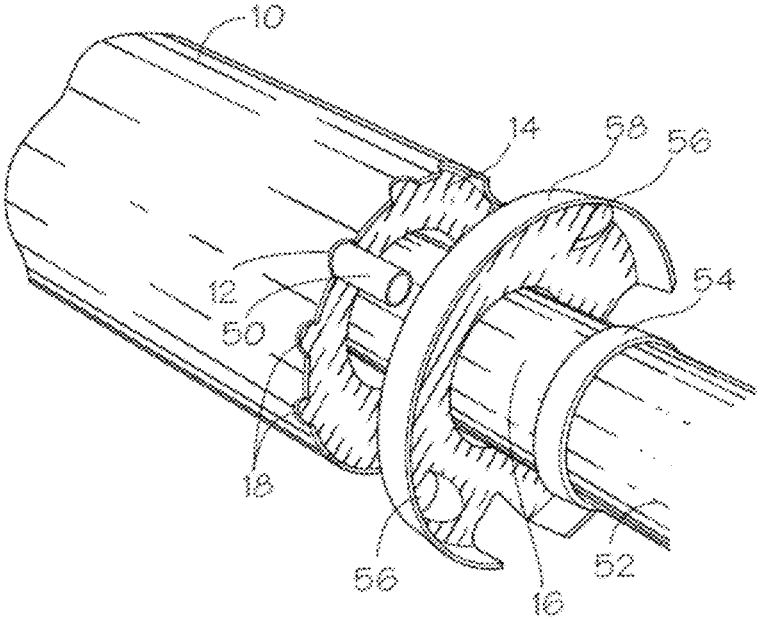
FIG. 7 shows one embodiment of a muzzle device of the current disclosure.

FIG. 7 shows one embodiment of a muzzle device 10 of the current disclosure. As FIG. 7 shows, muzzle device 10 may include anti-rotation pin 50 inserted into pin cavity 12. Muzzle device 10 is shown threaded onto a rifle barrel 52 with crush washer 54 serving to keep muzzle device 10 and rifle barrel 52 engaged. Anti-rotation pin 50 may be inserted into pin locking orifice 56 defined in handguard retainer 58. This prevents muzzle device 10 from rotating and/or unscrewing from rifle barrel 52. Typically, a stamped hand retainer has a hole, such as pin locking orifice 56, defined into handguard retainer 58, for allowing a gas tubing, not shown, to extrude through orifice 56. Inserting anti-rotation pin 50 into orifice 56 prohibits the handguard from rotating.

Figure 8:
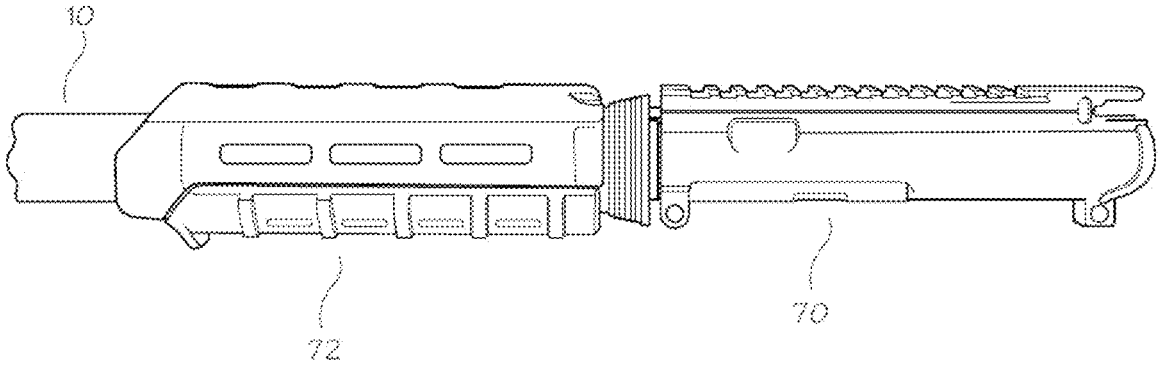
FIG. 8 shows a muzzle device of the current disclosure engaged with a rifle using a basic carbine length handguard.
Figure 9:
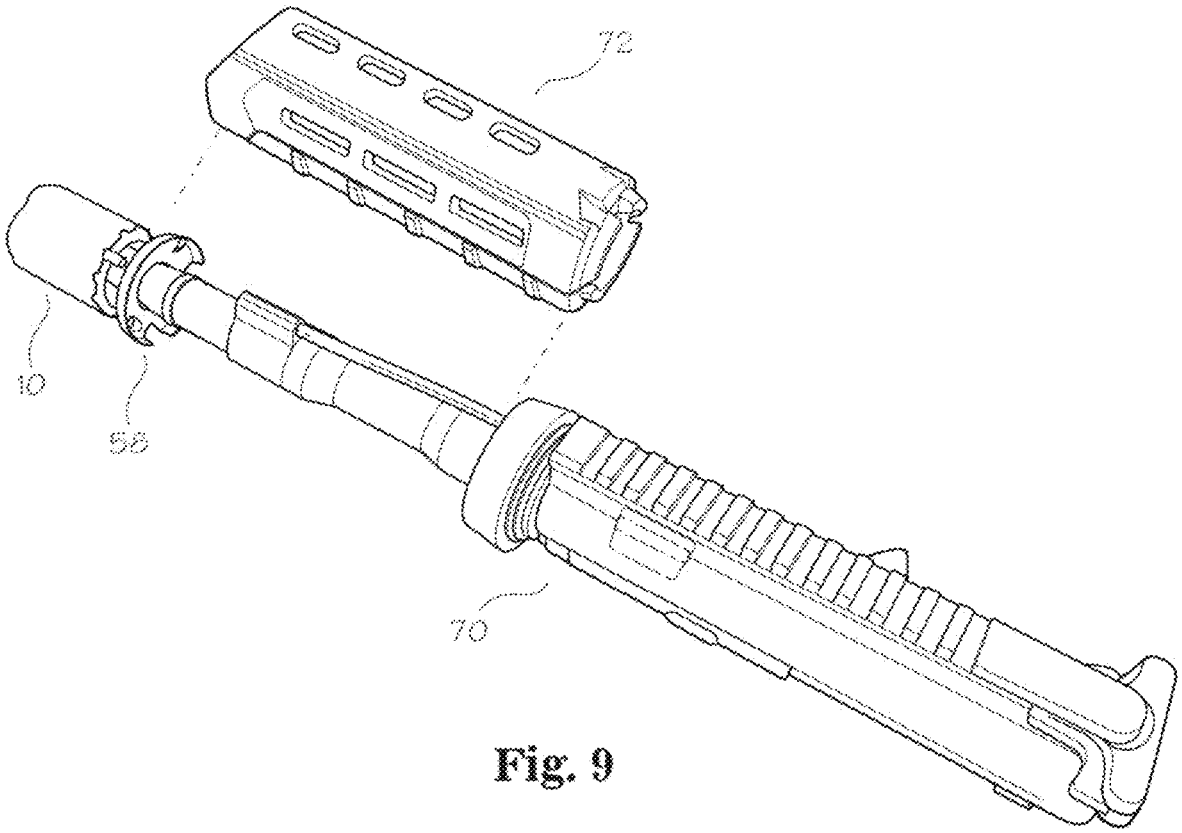
FIG. 9 shows a disassembled view of a muzzle device of the current disclosure affixed to a rifle with the basic carbine length handguard removed.

FIG. 8 shows a muzzle device 10 of the current disclosure engaged with a rifle 70 using a basic carbine length handguard 72. FIG. 9 shows a disassembled view of a muzzle device 10 affixed to a rifle 70 with handguard 72 not affixed.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A muzzle device for engagement with a handguard retainer of a firearm comprising:

a muzzle body, which is substantially cylindrical in shape, with a proximal and distal end;

a muzzle shelf defined adjacent the proximal end of the muzzle body formed substantially perpendicular to the muzzle body;

a hollow muzzle stem extending from the muzzle shelf;

an anti-rotation pin cavity defined within the muzzle shelf;

an anti-rotation pin extending through the muzzle shelf and extending at least partially through a cavity formed in the handguard retainer on the firearm; and wherein muzzle teeth are formed around a circumference of the proximal end of the muzzle body extending proximally away from the muzzle body and extending proximally beyond the muzzle shelf to create cavities in the muzzle body to allow for air flow between the handguard retainer and the muzzle shelf and to prevent the muzzle shelf from coming into contact with the handguard retainer.

2. The muzzle device of claim 1, wherein the muzzle stem is threaded on an interior of the muzzle stem.

3. The muzzle device of claim 1, wherein the pin cavity is substantially circular.

4. The muzzle device of claim 1, wherein the muzzle stem includes a stem notch defined within an outer surface of the muzzle stem.

5. The muzzle device of claim 1, wherein the muzzle body includes muzzle end divots defined in the distal periphery of the muzzle body.

6. The muzzle device of claim 1, wherein the hollow muzzle stem is configured to allow a bullet to pass through an entirety of the muzzle stem.

7. A method of preventing rotation of a muzzle device attached to a firearm comprising:

securing a muzzle device to the firearm;

wherein the muzzle device comprises a muzzle body, which is substantially cylindrical in shape, with a proximal and distal end;

a muzzle shelf defined adjacent the proximal end of the muzzle body formed substantially perpendicular to the muzzle body;

a hollow muzzle stem extending from the muzzle shelf;

an anti-rotation pin cavity defined within the muzzle shelf;

inserting an anti-rotation pin through the anti-rotation pin cavity in the muzzle shelf and into a pin locking orifice defined in a handguard retainer affixed to the firearm; and forming muzzle teeth are formed around a circumference of the proximal end of the muzzle body extending proximally away from the muzzle body and extending proximally beyond the muzzle shelf to create cavities in the muzzle body to allow for air flow between the handguard retainer and the muzzle shelf and to prevent the muzzle shelf from coming into contact with the handguard retainer.

8. The method of claim 7, wherein the pin locking orifice is formed by defining a cavity in a handguard retainer.

9. The method of claim 7, wherein the muzzle stem is threaded on an interior of the muzzle stem.

10. The method of claim 7, wherein the pin cavity is substantially circular.

11. The method of claim 7, wherein the muzzle stem includes a stem notch defined within an outer surface of the muzzle stem.

12. The method of claim 7, wherein the muzzle body includes muzzle end divots defined in the distal periphery of the muzzle body.

13. The method of claim 7, wherein the hollow muzzle stem is configured to allow a bullet to pass through an entirety of the muzzle stem.

* * * * *